US012791213B2

(12) United States Patent
Peng

(10) Patent No.: US 12,791,213 B2
(45) Date of Patent: Nov. 10, 2026

(54) CONTROL DEVICE AND METHOD, AND AIR CONDITIONING SYSTEM

(71) Applicant: Hangzhou Leaderway Electronics Co., Ltd., Hangzhou (CN)

(72) Inventor: Peng Peng, Hangzhou (CN)

(73) Assignee: Hangzhou Leaderway Electronics Co., Ltd., Hangzhou (CN)

( * ) Notice: Subject to any disclaimer, the term of this patent is extended or adjusted under 35 U.S.C. 154(b) by 322 days.

(21) Appl. No.: 18/285,382

(22) PCT Filed: Jun. 14, 2022

(86) PCT No.: PCT/CN2022/098646
§ 371 (c)(1),
(2) Date: Oct. 2, 2023

(87) PCT Pub. No.: WO2023/040379
PCT Pub. Date: Mar. 23, 2023

(65) Prior Publication Data

US 2024/0191895 A1 Jun. 13, 2024

(30) Foreign Application Priority Data

Sep. 17, 2021 (CN) ..... 202111093315.1
Dec. 27, 2021 (CN) ..... 202111615561.9

(51) Int. Cl.
*F24F 11/36* (2018.01)

(52) U.S. Cl.
CPC ..... *F24F 11/36* (2018.01)

(58) Field of Classification Search
CPC ..... F24F 11/36
(Continued)

(56) References Cited

U.S. PATENT DOCUMENTS 10,845,098 B2 * 11/2020 Xue ..... F25B 13/00
11,859,845 B1 * 1/2024 DeLoach ..... F24F 11/46
2012/0272672 A1 11/2012 Morimoto et al.

FOREIGN PATENT DOCUMENTS

CN 101929706 A 12/2010
CN 201875842 U 6/2011
(Continued)

OTHER PUBLICATIONS

FOR1, A Phase Sequence Detecting Circuit, Outdoor Machine Of Air Conditioner And Control Method, 2020, Full Document (Year: 2020).*

(Continued)

*Primary Examiner* — Nael N Babaa
(74) *Attorney, Agent, or Firm* — Wolf, Greenfield & Sacks, P.C.

(57) ABSTRACT

A control device and method, and an air conditioning system are provided. The control device includes a processing unit, an indoor control board power supply controllable switch and a refrigerant sensor interface. A terminal of the refrigerant sensor interface is electrically connected to the processing unit, and another terminal is electrically connected to a refrigerant sensor; or the refrigerant sensor interface communicates with the refrigerant sensor. A control terminal of the indoor control board power supply controllable switch is electrically connected to the processing unit, a first terminal is electrically connected to a power supply terminal of an indoor control board, and a second terminal is electrically connected to a control device power supply output terminal.

16 Claims, 9 Drawing Sheets

(58) Field of Classification Search
USPC ..... 62/126
See application file for complete search history.

(56) References Cited

FOREIGN PATENT DOCUMENTS

| | | | | | |
|---|---|---|---|---|---|
| CN | 102213463 | A | | 10/2011 | |
| CN | 104101066 | A | | 10/2014 | |
| CN | 106052038 | A | | 10/2016 | |
| CN | 106440584 | A | | 2/2017 | |
| CN | 107328022 | A | | 11/2017 | |
| CN | 109882989 | A | | 6/2019 | |
| CN | 110006151 | A | | 7/2019 | |
| CN | 110736183 | A | | 1/2020 | |
| CN | 111426890 | A | * | 7/2020 | ..... G01R 29/18 |
| CN | 113339883 | A | | 9/2021 | |
| CN | 114127480 | A | * | 3/2022 | ..... F24F 11/526 |
| KR | 100379283 | B1 | * | 4/2003 | ..... F24F 11/36 |

OTHER PUBLICATIONS

FOR2, Refrigeration Cycle System, 2020, Full Document (Year: 2020).*
FOR3, Automatic Leakage Checking Method Of Sperating Type Air-Conditioner, 2003, Full Document (Year: 2003).*
PCT/CN2022/098646, Sep. 1, 2022, International Search Report and Written Opinion.
International Search Report and Written Opinion for International Application No. PCT/CN2022/098646, mailed Sep. 1, 2022.
First Office Action for Chinese Application No. 202111615561.9, dated Mar. 26, 2026.

* cited by examiner

CONTROL DEVICE AND METHOD, AND AIR CONDITIONING SYSTEM

This application is a national stage filing under 35 U.S.C. § 371 of International Patent Application Serial No. PCT/CN2022/098646, filed Jun. 14, 2022, which claims priority to Chinese Patent Application No. 202111615561.9, titled "CONTROL DEVICE AND METHOD, AND AIR CONDITIONING SYSTEM", filed on Dec. 27, 2021, and Chinese Patent Application No. 202111093315.1, titled "CONTROL DEVICE AND METHOD, AND AIR CONDITIONING SYSTEM", filed on Sep. 17, 2021 with the China National Intellectual Property Administration. The contents of these applications are incorporated herein by reference in their entireties.

FIELD

The present disclosure relates to the technical field of air conditioning technology, and in particular to a control device and method, and an air conditioning system related to refrigerant leakage.

BACKGROUND

At present, in the most refrigerant detection methods, some parameters of an air conditioning system are collected during operating, such as a system pressure, a coil temperature, an air outlet temperature, an environmental temperature, and the collected data is compared with data tested in laboratory during the design of the air conditioning system. If the collected data deviates significantly from the data tested in the laboratory, the refrigerant of the air conditioning system is leaked; otherwise, the air conditioning system is normal.

However, the reliability and safety of the refrigerant detection methods are low.

SUMMARY

In view of this, a control device and method, and an air conditioning system are provided according to embodiments of the present disclosure, which can detect information related to refrigerant concentration by using a refrigerant sensor and perform control in a case that the refrigerant is leaked, realizing high reliability and safety.

In the first aspect, a control device is provided according to the embodiments of the present disclosure, which includes a processing unit, an indoor control board power supply controllable switch, and at least one refrigerant sensor interface. A terminal of the refrigerant sensor interface is electrically connected to the processing unit, and another terminal of the refrigerant sensor interface(s) is electrically connected to a refrigerant sensor; or the refrigerant sensor interface communicates with the refrigerant sensor, and the processing unit is configured to acquire refrigerant information from the refrigerant sensor at least through the refrigerant sensor interface. A control terminal of the indoor control board power supply controllable switch is electrically connected to the processing unit, a first terminal of the indoor control board power supply controllable switch is electrically connected to a power supply terminal of an indoor control board, and a second terminal of the indoor control board power supply controllable switch is electrically connected to a control device power supply output terminal; and the processing unit is configured to control the indoor control board power supply controllable switch to be turned on or turned off at least based on the refrigerant information, to turn on or turn off the indoor control board. The control device detects information related to refrigerant concentration through the refrigerant sensor connected therewith and determines whether the refrigerant is leaked, and performs control based on a determination result, which can improve reliability and safety.

In the second aspect, a control method is provided according to the embodiments of the present disclosure, which is applied to an air conditioning system and includes:

acquiring refrigerant information from a refrigerant sensor, and determining whether refrigerant is leaked based on the refrigerant information; and generating, in a case that the refrigerant is leaked, a control signal for turning off an indoor control board power supply controllable switch of the air conditioning system, to turn off an indoor control board of the air conditioning system.

The method acquires refrigerant information from the refrigerant sensor and determines whether the refrigerant is leaked, and performs control based on a determination result, which can improve reliability and safety.

In a third aspect, an air conditioning system is provided according to the embodiments of the present disclosure, which includes an indoor control board and a control device as described in the above. A power supply input terminal of the control device may be electrically connected to an input power supply. The air conditioning system includes the above control device and also has high reliability and safety.

DETAILED DESCRIPTION OF EMBODIMENTS

In order to better understand the technical solutions of the present disclosure, embodiments of the present disclosure are described in detail below in conjunction with the drawings.

It should be clarified that the described embodiments are only a part of the embodiments of the present disclosure, rather than all of the embodiments. Based on the embodiments in the present disclosure, all other embodiments obtained by those skilled in the art without creative efforts fall within the protection scope of the present disclosure.

It should be understood that the term "and/or" herein is only used for describing the association relationship of the associated objects, indicating that there are three types of relationships, for example, A and/or B may represent three situations: A exists alone, A and B exist simultaneously, and B exists alone. In addition, the character "/" herein generally indicates that the pre and post associated objects has a relationship of "or".

Figure 1:
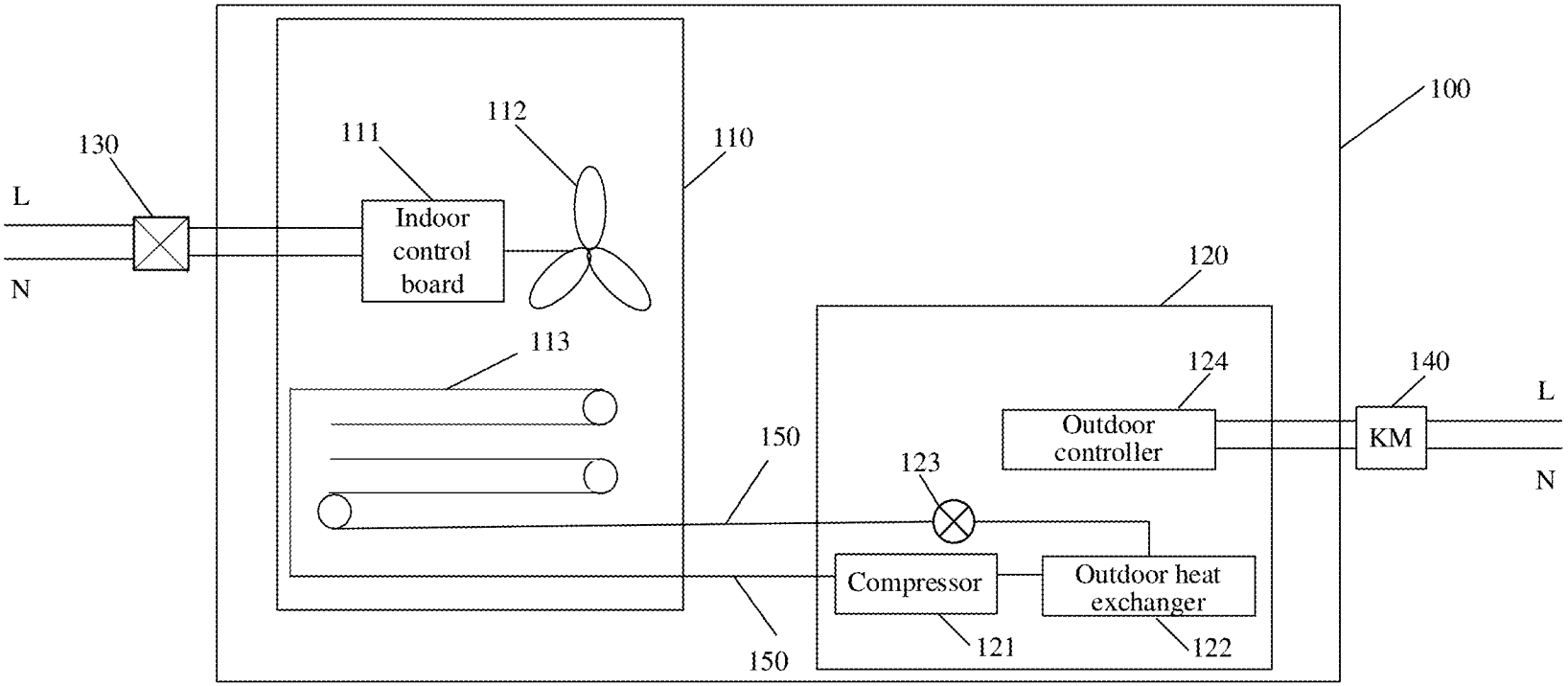
FIG. 1 is a schematic diagram of an air conditioning system.

FIG. 1 is a schematic diagram of an air conditioning system. The air conditioning system 100 includes an indoor unit 110 and an outdoor unit 120. The indoor unit 110 includes an indoor control board 111, an indoor fan 112, and an indoor coil 113. The outdoor unit 120 includes a compressor 121, an outdoor heat exchanger 122, a throttle valve 123, and an outdoor controller 124. A refrigerant pipe 150 is arranged between the indoor unit 110 and the outdoor unit 120. A transformer 130 converts power of the power supply (such as AC power supply) to supply power to the indoor control board 111. The power supply supplies power to the outdoor controller 124 through a contactor 140. In a case that the air conditioning system uses combustible refrigerant, a technical problem needs to be solved is how to ensure safe usage.

Based on this, a control device and method, and an air conditioning system are provided according to the embodiments of the present disclosure. The control device and method, and air conditioning system can detect information related to refrigerant concentration through a refrigerant sensor and perform control in a case that the refrigerant is leaked, which can realize high reliability and safety.

Figure 2:
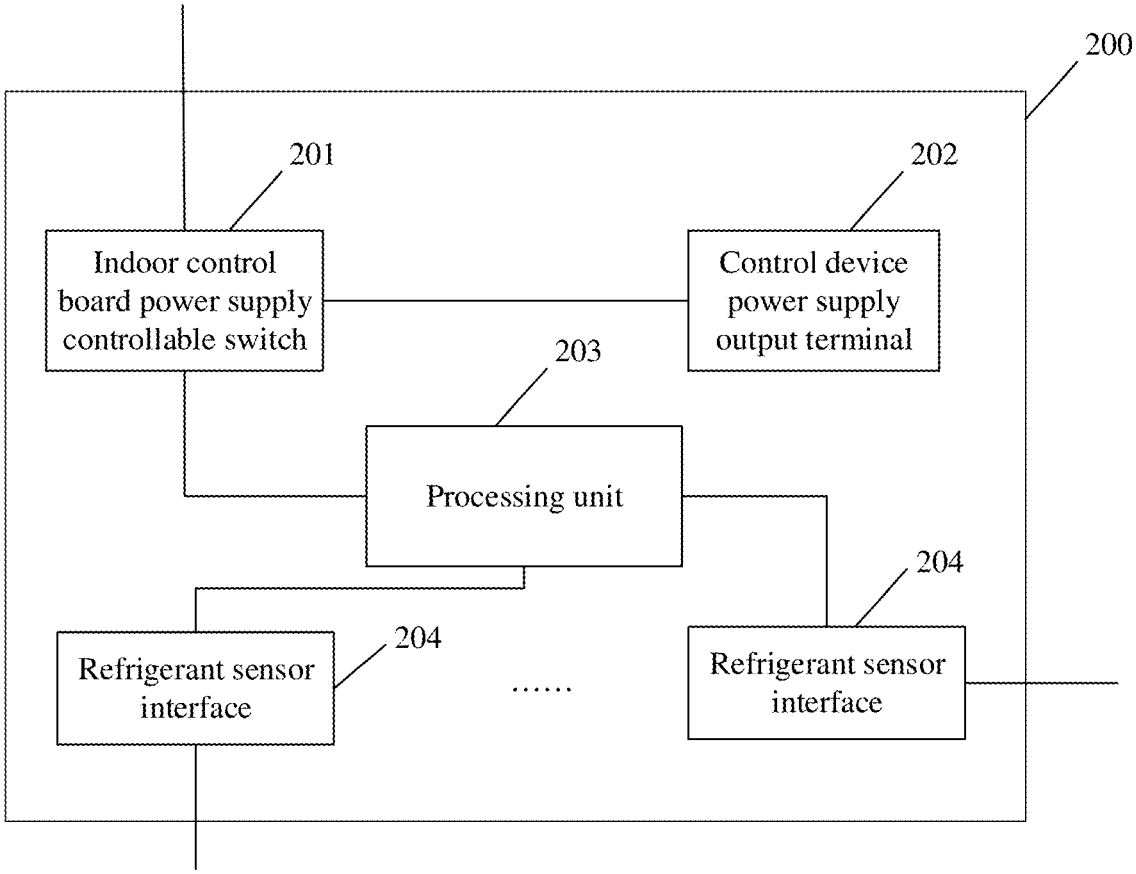
FIG. 2 is a block diagram of a control device according to an embodiment of the present disclosure.
Figure 4:
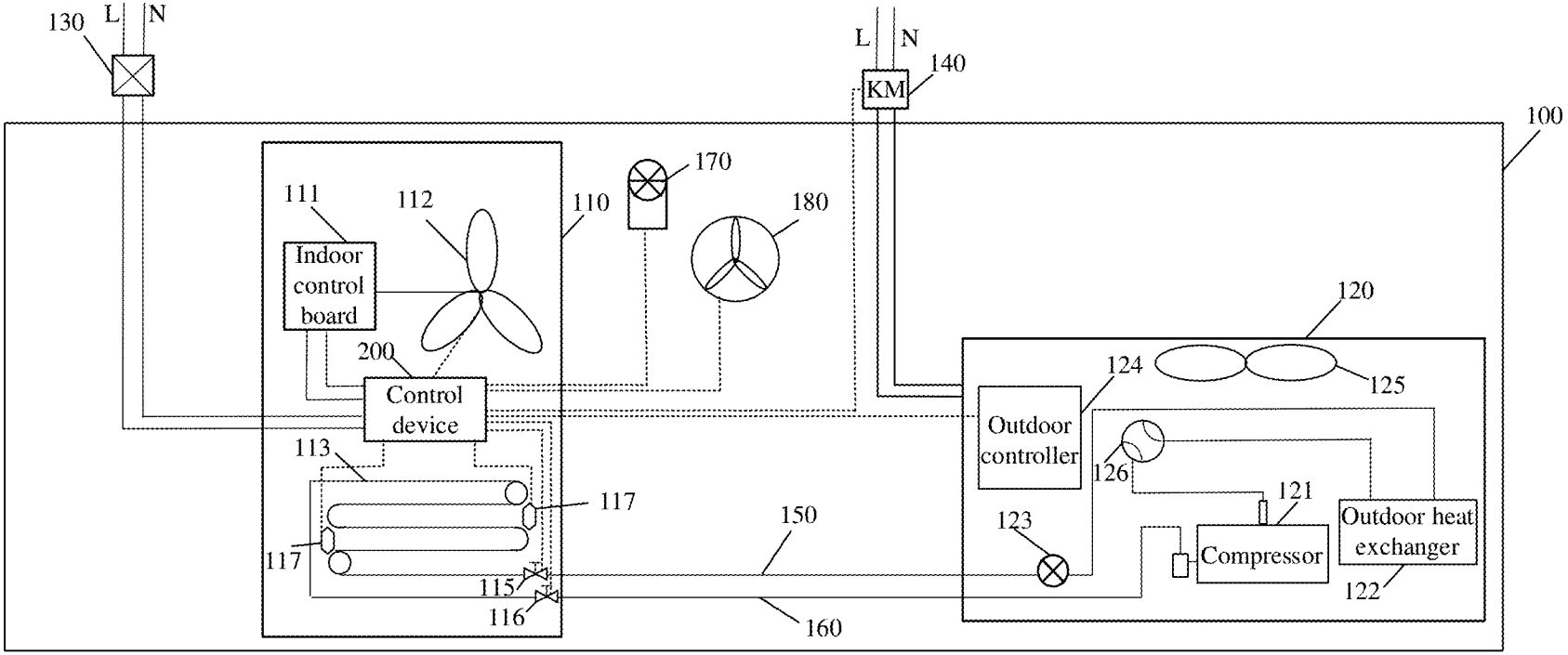
FIG. 4 is a schematic diagram of an air conditioning system according to an embodiment of the present disclosure.

As shown in FIG. 2 or FIG. 4, the control device 200 includes: a processing unit 203, an indoor control board power supply controllable switch 201 and at least one refrigerant sensor interface 204. A terminal of the refrigerant sensor interface 204 is electrically connected to the processing unit 203, and another terminal of the refrigerant sensor interface 204 may be electrically connected to a refrigerant sensor 117. The processing unit 203 is configured to acquire refrigerant information from the refrigerant sensor 117 at least through the refrigerant sensor interface 204. Specifically, the refrigerant sensor interface 204 may be a wireless communication interface and/or wired communication interface, and the refrigerant information detected by the refrigerant sensors may be sent to the processing unit at least through the wireless communication interface and/or wired communication interface. A control terminal of the indoor control board power supply controllable switch 201 is electrically connected to the processing unit 203, a first terminal of the indoor control board power supply controllable switch 201 may be electrically connected to a power supply terminal of the indoor control board 111, and a second terminal of the indoor control board power supply controllable switch 201 is electrically connected to a control device power supply output terminal 202. The processing unit 203 is configured to control the indoor control board power supply controllable switch 201 to be turned on or turned off at least based on the refrigerant information, to turn on or turn off the indoor control board 111.

In another embodiment, the refrigerant sensors may be integrated into the control device. In this embodiment, the control device includes a processing unit, an indoor control board power supply controllable switch and a refrigerant sensor. The refrigerant sensor is electrically connected to the processing unit to send refrigerant information to the processing unit. A control terminal of the indoor control board power supply controllable switch is electrically connected to the processing unit, a first terminal of the indoor control board power supply controllable switch may be electrically connected to the power supply terminal of an indoor control board, and a second terminal of the indoor control board power supply controllable switch is electrically connected to a control device power supply output terminal. The processing unit is configured to control the indoor control board power supply controllable switch to be turned on or turned off at least based on the refrigerant information from the refrigerant sensor, to turn on or turn off the indoor control board. When the control device is turned on, the processing unit 203 of the control device 200 controls the indoor control board power supply controllable switch 201 to be turned on, to turn on the indoor control board 111. If the control device 200 detects a refrigerant leakage, the processing unit 203 controls the indoor control board power supply controllable switch 201 to be turned off, to turn off the indoor control board 111.

Currently, the indoor control board 111 in the air conditioning system 100 maintains in a powered-on state after the air conditioning system 100 is turned on, there is a strict explosion-proof requirement for the indoor control board 111. In the embodiment of the present disclosure, the control device 200 is arranged in the air conditioning system 100, as the control device 200 includes the indoor control board power supply controllable switch 201, in the case that refrigerant is leaked, the processing unit 203 of the control device 200 can turn off the indoor control board 111. Therefore, it is unnecessary for the indoor control board 111 to meet the explosion-proof requirement. However, the control device 200 needs to meet an explosion-proof requirement of a corresponding level, for example, the control device 200 needs to meet IEC 60079 explosion-proof certification. In some cases, if the refrigerant sensor is further integrated into the control device according to the present disclosure, the circuit part of the integrated refrigerant sensor also needs to have explosion-proof function, so that the entire control device has explosion-proof function. If the indoor control board is further integrated into the control device according to the present disclosure, a control circuit of the integrated indoor board also needs to have explosion-proof design, and the integrated devices should also be explosion-proof devices, especially for controllable switches, fuses, and other devices.

The control device of the integrated refrigerant sensor has explosion-proof function. In case of a refrigerant leakage, the indoor control board may be turned off, that is, the indoor control board is no longer turned on when the refrigerant is leaked. Thus, the indoor control board may be designed according to conventional standard without explosion-proof function. When the control device integrates the refrigerant sensors and the indoor control board, preferably, the entire control device has explosion-proof function.

In an embodiment, the control device power supply output terminal 202 has the same or similar potential as the power supply input terminal of the control device. Specifically, the control device power supply output terminal 202 is directly electrically connected to the power supply input terminal of the control device or indirectly electrically connected to the power supply input terminal of the control device via other devices such as a fuse.

It should be noted that the power inputted to the power supply input terminal of the control device may be a frequency power, such as AC 220V, AC 230V. The frequency power is inputted to the power supply input terminal of the control device through a transformer. Alternatively, the power inputted to the power supply input terminal of the control device may also be AC/DC24V or a power with other voltages, which is converted into the working voltage of other components (such as indoor control board, indoor fan) in the air conditioning system 100 through corresponding voltage converters.

In the embodiment of the present disclosure, the signal output types of the refrigerant sensors 117 include a voltage type, a current type, a switch type, or a 485 communication type, etc., that is, the refrigerant information may be characterized by signals of the voltage type, the current type, the switch type, or by signals transmitted through 485 communication. Correspondingly, each refrigerant sensor 117 has an interface of a corresponding signal input type. The refrigerant information may be refrigerant concentration information or information for determining whether the refrigerant is leaked.

The number of the refrigerant sensor interfaces 204 may be set according to actual needs, which is not limited in the embodiment. For example, the control device 200 includes multiple refrigerant sensor interfaces 204. Specifically, the control device 200 may include at least one refrigerant sensor interface with an input type of a voltage type, at least one refrigerant sensor interface with an input type of a current type, at least one refrigerant sensor interface with an input type of a switch type, and at least one refrigerant sensor interface with an input type of a RS485 type.

In a case that the signal output type of a refrigerant sensor 117 is the voltage type, a voltage signal representing the refrigerant concentration is outputted to the processing unit 203 of the control device 200, and the processing unit 203 determines whether the refrigerant is leaked based on the voltage signal.

In a case that the signal output type of a refrigerant sensor 117 is the current type, a current signal representing the refrigerant concentration is outputted to the processing unit 203 of the control device 200, and the processing unit 203 determines whether the refrigerant is leaked based on the current signal.

In a case that the signal output type of a refrigerant sensor 117 is the switch type, a signal of 0 or 1 representing the refrigerant concentration is outputted to the processing unit 203 of the control device 200, and the processing unit 200 determines whether the refrigerant is leaked based on the signal of 0 or 1 or a combination thereof.

In a case that the signal output type of a refrigerant sensor is a RS485 communication type, a digital signal representing the refrigerant concentration and/or whether the refrigerant is leaked is outputted to the processing unit 203 of the control device 200, and the processing unit 203 determines whether the refrigerant is leaked based on the digital signal.

In the embodiment of the present disclosure, as shown in FIG. 4, the refrigerant sensor 117 is arranged at a position in the refrigeration coil 113 of the air conditioning system 100 where the refrigerant is prone to accumulate or leak. For example, the refrigerant sensor is arranged at a joint of the indoor copper coil and/or at the bend of the indoor copper coil. The refrigerant sensor may be one or more of a A2L sensor, a thermal conductivity sensor, a semiconductor sensor, an infrared sensor, an acoustic sensor, an ultraviolet sensor, etc., which is not limited by the present disclosure.

In the embodiment of the present disclosure, the control device 100 and at least one refrigerant sensor are arranged in the air conditioning system, the information related to the refrigerant concentration may be detected. Therefore, it is determined whether the refrigerant is leaked based on the detected refrigerant concentration. Compared to determining whether the refrigerant is leaked by collecting some parameters during the running of the air conditioning system, the accuracy is higher, and the reliability and safety are higher. Specifically, the control device 200 and the refrigerant sensor according to the present disclosure may be arranged in the air conditioning system 100, and the air conditioning system 100 may be improved to have a refrigerant detection function. Alternatively, the control device 200 and at least one refrigerant sensor 117 according to the present disclosure are directly arranged during the design of the air conditioning system. Thus, the air conditioning system 100 has the refrigerant detection function when it leaves the factory. Alternatively, the refrigerant sensor may also be integrated into the control device 200, and further, the indoor control board may also be integrated into the control device 200.

Figure 3:
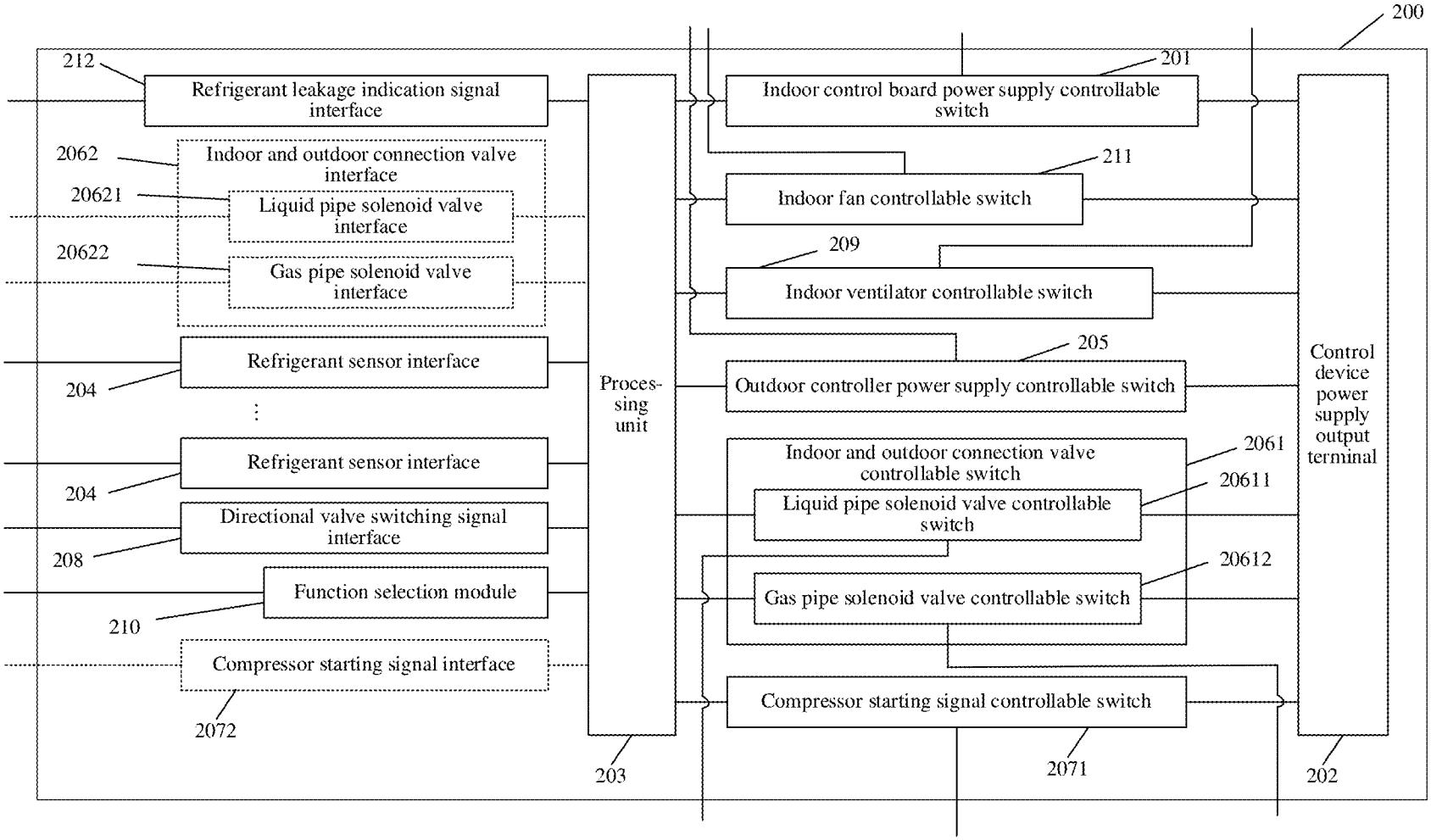
FIG. 3 is a block diagram of a control device according to another embodiment of the present disclosure.

As shown in FIG. 3, the control device 200 further includes an indoor fan controllable switch 211. A control terminal of the indoor fan controllable switch 211 is electrically connected to the processing unit 203, a first terminal of the indoor fan controllable switch 211 may be electrically connected to the indoor fan 112, and the second terminal of the indoor fan controllable switch 211 is electrically connected to the control device power supply output terminal 202. The processing unit 203 is configured to control the indoor fan controllable switch 211 to be turned on or turned off at least based on the refrigerant information, to start or stop the indoor fan 112.

In the embodiment of the present disclosure, the air conditioning system includes the indoor fan 112. After the control device 200 detects that the refrigerant is leaked, the processing unit 203 of the control device 200 controls the indoor fan controllable switch 211 to be turned on, to start the indoor fan 112. The indoor fan 112 can quickly diffuse the leaked refrigerant, to prevent the accumulation of the leaked refrigerant, reducing the refrigerant concentration, thus preventing safety hazards (prevent safety hazards). The indoor fan operating at the maximum rotating speed can blow away the leaked refrigerant at the fastest speed, to prevent refrigerant accumulation and risks thus brought.

As shown in FIG. 3, the control device 200 further includes an outdoor controller power supply controllable switch 205, an indoor and outdoor connection valve controllable switch 2061 or an indoor and outdoor connection valve interface 2062, a compressor starting signal controllable switch 2071 or a compressor starting signal interface 2072.

A control terminal of the outdoor controller power supply controllable switch 205 is electrically connected to the processing unit 203, a first terminal of the outdoor controller power supply controllable switch 205 may be electrically connected to the power supply terminal of the outdoor controller 124, and a second terminal of the outdoor controller power supply controllable switch 205 is electrically connected to the control device power supply output terminal 202. The processing unit 203 is configured to control the outdoor controller power supply controllable switch 205 to be turned on or turned off at least based on the refrigerant information, to turn on or turn off the outdoor controller 124.

The outdoor controller 124 may control the outdoor controller power supply in a fixed frequency or a variable frequency. For fixed frequency, the outdoor controller 124 may include a starting capacitor, and for variable frequency, the outdoor controller 124 includes a variable frequency controller. In some embodiments, the outdoor controller 124 further includes an outdoor power supply relay. In this case, a first terminal of the outdoor controller power supply controllable switch 205 is electrically connected to the outdoor power supply relay, to control the outdoor power relay to be turned on or turned off, to turn on or turn off the outdoor controller.

In a case that the refrigerant is leaked, in order to recovery the refrigerant, the processing unit 203 of the control device 200 controls the outdoor controller power supply controllable switch 205 to be turned on, to turn on the outdoor controller 124.

A control terminal of the indoor and outdoor connection valve controllable switch 206 is electrically connected to the processing unit 203, a first terminal of the indoor and outdoor connection valve controllable switch 206 may be electrically connected to the indoor and outdoor connection valve, and a second terminal of the indoor and outdoor connection valve controllable switch 206 is electrically connected to the control device power supply output terminal 202. In this embodiment, the indoor and outdoor connection valve is controlled to be opened or closed by turning on or off the indoor and outdoor connection valve.

In another embodiment, if the indoor and outdoor connection valve itself has a processing unit, a terminal of the indoor and outdoor connection valve interface 206 may be electrically connected to the processing unit 203, and another terminal is electrically connected to the indoor and outdoor solenoid valve, specifically, to the processing unit of the indoor and outdoor connection valve. The processing unit 203 of the control device sends an on or off signal to the processing unit of the indoor and outdoor connection valve through the indoor and outdoor connection valve interface 206 at least based on the refrigerant information, to open or close the indoor and outdoor connection valve.

It should be noted that the indoor and outdoor connection valve controllable switch 2061 includes a liquid pipe solenoid valve controllable switch 20611 and a gas pipe solenoid valve controllable switch 20612; or the indoor and outdoor connection valve interface 2062 includes a liquid pipe solenoid valve interface 20621 and a gas pipe solenoid valve interface 20622.

In the embodiment of the present disclosure, the air conditioning system includes the indoor and outdoor connection valve controllable switch 2061 or the indoor and outdoor connection valve interface 2062. Referring to FIG. 4, in a case that the control device 200 detects that the refrigerant is leaked, the processing unit 203 of the control device 200 controls the liquid pipe solenoid valve controllable switch 20611 to be turned off, to close the liquid pipe solenoid valve 115. The processing unit 203 controls the gas pipe solenoid valve controllable switch 20612 to be turned on, to open the gas pipe solenoid valve 116. Alternatively, in a case that the control device 200 detects that the refrigerant is leaked, the processing unit 203 of the control device 200 sends a liquid pipe solenoid valve closing signal and a gas pipe solenoid valve opening signal to the indoor and outdoor connection valve at least based on the refrigerant information, to close the liquid pipe solenoid valve 115 and open the gas pipe solenoid valve 116.

In a case that the gas pipe solenoid valve 115 is opened, the refrigerant may be recovered from the indoor refrigerant pipe or coil to the outdoor refrigerant pipe or the compressor. In a case that the liquid pipe solenoid valve 116 is closed, the refrigerant cannot flow from the outdoor refrigerant pipe or the compressor into the indoor refrigerant pipe or coil, reducing the indoor refrigerant concentration, thus preventing safety hazards.

A control terminal of the compressor starting signal controllable switch 2071 is electrically connected to the processing unit 203, a first terminal of the compressor starting signal controllable switch 2071 may be electrically connected to the compressor 121, and a second terminal of the compressor starting signal controllable switch 2071 is electrically connected to the control device power supply output terminal 202. This method is applicable to a fixed frequency air conditioning system. The outdoor unit 120 of the air conditioning system includes a starting capacitor, and the processing unit 203 of the control device 200 may control the compressor starting signal controllable switch to be turned on or turned off at least based on the refrigerant information, to start or stop the compressor.

In an embodiment, a terminal of the compressor starting signal interface 2072 is electrically connected to the processing unit 203, and another terminal may be electrically connected to the compressor 121. This method is applicable to a variable frequency air conditioning system. The outdoor unit 120 of the air conditioning system includes a variable frequency outdoor controller. In this case, the processing unit 203 of the control device 200 may send a compressor starting signal to the variable frequency outdoor controller through the compressor starting signal interface 2072 at least based on the refrigerant information, to start or stop the compressor 121.

In the embodiment of the present disclosure, referring to FIG. 4, the air conditioning system includes the compressor 121. In a case that the control device 200 detects that the refrigerant is leaked, the processing unit 203 of the control device 200 controls the compressor starting signal controllable switch 2071 to be turned on, to start the compressor 121. Alternatively, in a case that the control device 200 detects that the refrigerant is leaked, the processing unit 203 of the control device 200 sends a compressor starting signal to the variable frequency outdoor controller, to start the compressor 121. In a case that the air conditioning system 100 is in a refrigeration mode, the compressor 121 may continuously draw out the refrigerant from the indoor unit, to reduce the refrigerant concentration in the room to prevent the refrigerant from accumulating in the room and safety hazards. In order to improve the efficiency of discharging the refrigerant, the compressor 121 may operate at the maximum frequency under full load. Further, as shown in FIG. 3, the control device 200 further includes a directional valve switching signal interface 208 and/or an indoor ventilator controllable switch 209.

A terminal of the directional valve switching signal interface 208 is electrically connected to the processing unit 203, and another terminal may be electrically connected to a directional valve 126. The processing unit 203 is configured to send a directional valve switching signal to the directional valve 126 at least based on the refrigerant information, to control the state of the directional valve 126. For example, by switching the state of the directional valve, the air conditioning system 100 switches from a heating mode to a refrigeration mode.

In the embodiment of the present disclosure, the air conditioning system 100 includes the directional valve switching interface 208. In a case that the control device 200 detects that the refrigerant is leaked, the processing unit 203 of the control device 200 sends a directional valve switching signal to the directional valve 126, to switch the directional valve 126 to a first state, where the first state is a state for controlling the air conditioning system in the refrigeration mode, the air conditioning system is switched to the refrigeration mode, to realize refrigerant recovery.

A control terminal of the indoor ventilator controllable switch 209 is electrically connected to the processing unit 203, a first terminal of indoor ventilator controllable switch 209 may be electrically connected to an indoor ventilator 180, and a second terminal of the indoor ventilator controllable switch 209 is electrically connected to the control device power supply output terminal 202. The processing unit 203 is configured to control the indoor ventilator controllable switch 209 to be turned on or turned off at least based on the refrigerant information, to start or stop the indoor ventilator 180.

It should be noted that, referring to FIG. 4, the air conditioning system in the embodiment of the present disclosure includes the indoor ventilator 180. In a case that the control device 200 detects that the refrigerant is leaked, the indoor ventilator 180 is started, which can discharge the refrigerant accumulated in the room to the outside, thereby quickly reducing the indoor refrigerant concentration, thus preventing safety hazards.

As shown in FIGS. 3 and 4, the control device 200 further includes a refrigerant leakage indication signal interface 212, a terminal of the refrigerant leakage indication signal interface 212 is electrically connected to the processing unit 203, and another terminal may be electrically connected to a remote indication device 170. The processing unit 203 is configured to send a refrigerant leakage indication signal to the remote indication device 170 at least based on the refrigerant information, to control the remote indication device 170 to issue an alarm.

In an embodiment, the air conditioning system includes a fault indication signal interface 212. In a case that the control device 200 detects that the refrigerant is leaked, the processing unit 203 of the control device 200 sends a refrigerant leakage indication signal to the remote indication device 170, to control the remote indication device 170 to issue an alarm. The remote indication device 170 may remotely indicate whether there is a leakage fault by means of a warning light or signal.

As shown in FIG. 3, the control device 200 further includes a function selection module 210. The processing unit 203 is configured to select, based on the number of refrigerant sensors set by the function selection module 210, the number of interfaces for processing corresponding to the number of refrigerant sensors. Alternatively, the processing unit 203 is configured to select, based on a data input type set by the function selection module 210, a data processing type corresponding to the data input type. Alternatively, the processing unit 203 is configured to select a corresponding function mode based on whether the refrigerant recovery function is set by the function selection module 210.

In the embodiment of the present disclosure, various detection functions of the refrigerant sensors may be realized through the function selection module 210. For example, the function selection module 210 includes a 4-bit dial switch, i.e. SW1-1. SW1-2, SW1-3 and SW1-4. The processing function of the control device 200 may be selected by setting the state of the dial switch of different bits. For example, SW1-1 may be used to set whether the control device 200 is connected to one refrigerant sensor or two refrigerant sensors, where the refrigerant sensor may be an A2L sensor. The processing unit 203 may perform different processing processes depending on different numbers of refrigerant sensors. SW1-2 and SW1-3 are used to set whether the data input type of the control system 200 is a current type, a voltage type, a switch type, or a 485 communication type. The processing unit 203 may perform different processing processes depending on different data input types. SW1-4 is used to set whether the control device 200 has a refrigerant recovery function. The processing unit 203 may perform different processing processes depending on different function modes.

Figure 5:
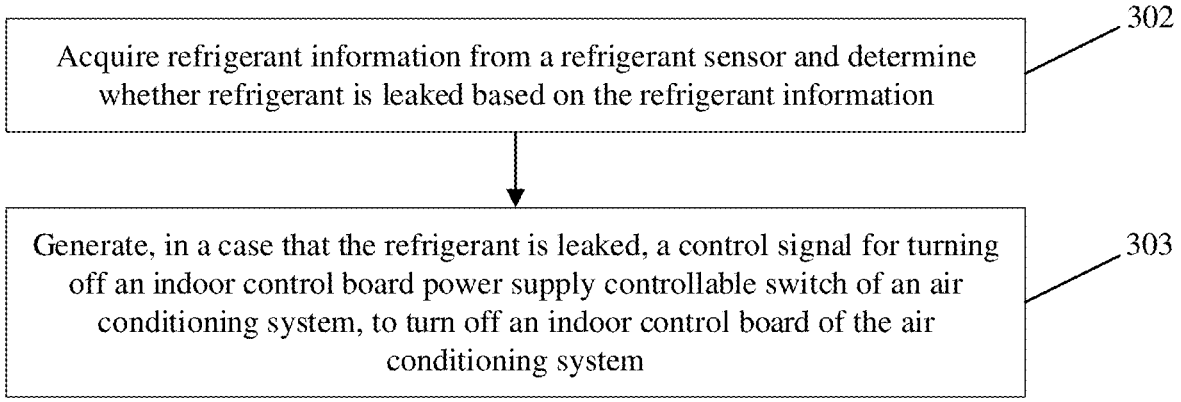
FIG. 5 is a flowchart of a control method according to an embodiment of the present disclosure.
Figure 6:
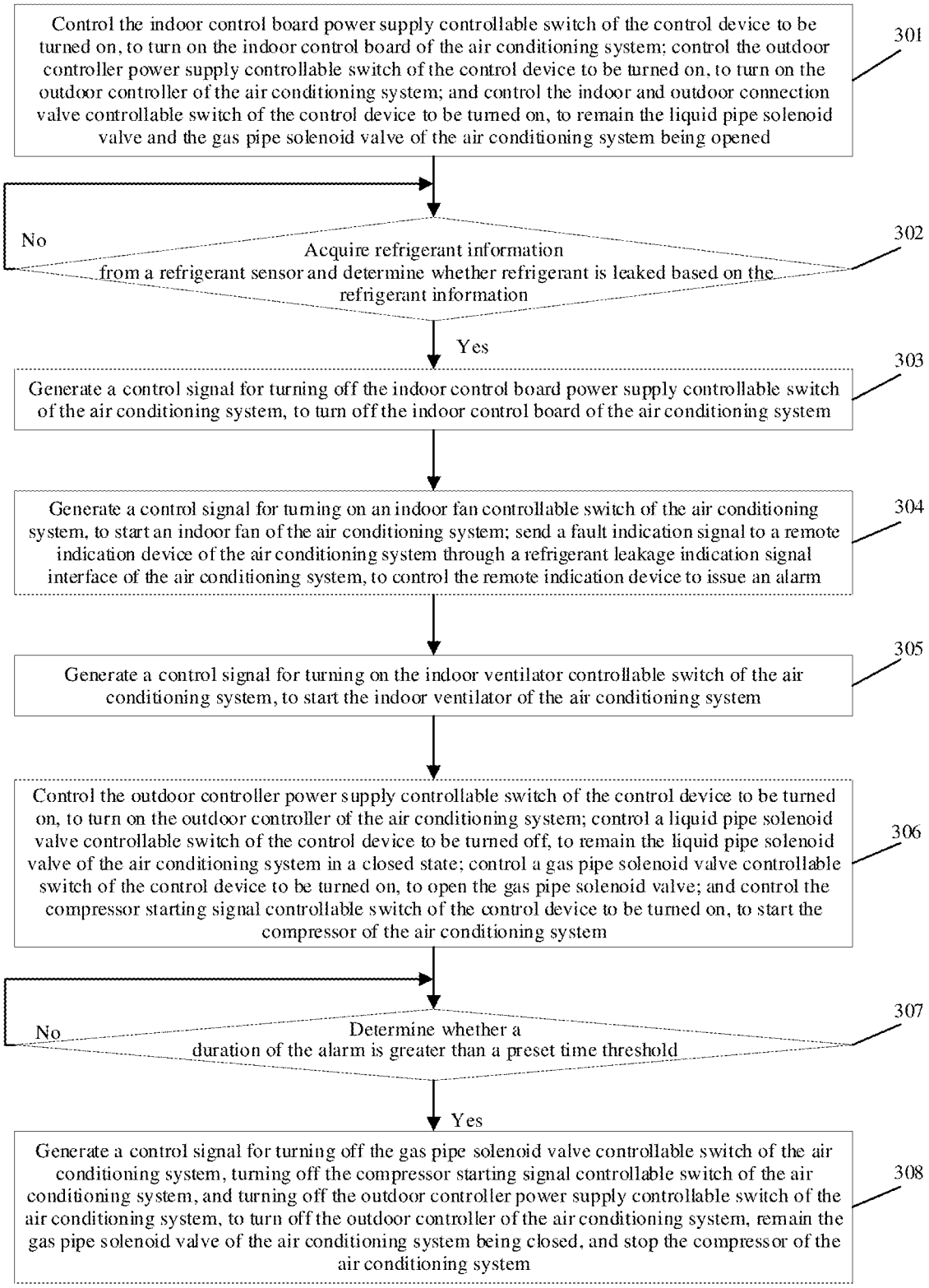
FIG. 6 is a flowchart of a control method according to another embodiment of the present disclosure.

Based on the control device 200 shown in FIG. 2 and the air conditioning system 100 shown in FIG. 4, FIGS. 5 and 6 show a flowchart of a control method according to an embodiment of the present disclosure. As shown in FIGS. 5 and 6, the method includes the following steps 301 to 308.

In step 301, the indoor control board power supply controllable switch 201 of the control device 200 is controlled to be turned on, to turn on the indoor control board 111 of the air conditioning system 100, the outdoor controller power supply controllable switch 205 of the control device 200 is controlled to be turned on, to turn on the outdoor controller 124 of the air conditioning system 100, and the indoor and outdoor connection valve controllable switch 2061 of the control device 200 is controlled to be turned on, to maintain the liquid pipe solenoid valve 115 and the gas pipe solenoid valve 116 of the air conditioning system 100 being opened.

In this step, in a case that the control device 200 is turned on and no refrigerant is leaked, the indoor control board 111 and the outdoor controller 124 are turned on to ensure the normal operation of the air conditioning system 100.

In step 302, the refrigerant information is acquired from the refrigerant sensor 117 and it is determined whether the refrigerant is leaked based on the refrigerant information. If the refrigerant is leaked, step 303 is performed; if the refrigerant is not leaked, step 302 is performed continually.

In the embodiment of the present disclosure, the refrigerant sensor 117 is arranged at a position in the refrigeration coil 113 of the air conditioning system 100 where the refrigerant is prone to accumulate or leak.

In an embodiment, the refrigerant information includes refrigerant concentration and/or refrigerant concentration growth rate. The processing unit 203 is specifically configured to determine whether the refrigerant concentration is greater than a preset refrigerant concentration continually for one or more number of times, and/or to determine whether the refrigerant concentration growth rate is greater than a preset refrigerant growth rate. The processing unit 203 periodically acquires the refrigerant concentration sent by the refrigerant sensor 117, and acquires the refrigerant concentration growth rate based on the refrigerant concentration.

It should be noted that the refrigerant concentration being greater than a preset refrigerant concentration continually for one or more number of times may include that the refrigerant concentration is greater than the preset refrigerant concentration continually for two or more number of times, or the refrigerant concentration is greater than the preset refrigerant concentration once.

In the embodiment of the present disclosure, by determining whether the refrigerant concentration is greater than the preset refrigerant concentration continually for one or more number of times, and/or determining whether the refrigerant concentration growth rate is greater than the preset refrigerant growth rate, it is determined whether the refrigerant is leaked. Thus, the misjudgment rate of the processing unit 203 in determining whether the refrigerant is leaked is reduced, and the safety and reliability are higher.

In the embodiment of the present disclosure, the alarm point of the remote indication device 170 in the air conditioning system 100 is set based on the preset refrigerant concentration and the preset refrigerant concentration growth rate. Specifically, the alarm point of the remote indication device 170 may be set depending on different air conditioning systems 100.

It should be noted that steps 301 and 302 may be performed simultaneously.

In step 303, a control signal for turning off the indoor control board power supply controllable switch 201 of the air conditioning system 100 is generated, to turn off the indoor control board 111 of the air conditioning system.

In the embodiment of the present disclosure, as shown in FIG. 4, the processing unit 203 of the control device 200 generates a control signal for turning off the indoor control board power supply controllable switch 201 of the air conditioning system, to turn off the indoor control board 111 of the air conditioning system, to prevent the indoor control board 111 from generating electric sparks, preventing safety hazards.

In step 304, a control signal for turning on the indoor fan controllable switch 211 of the air conditioning system 100, to start the indoor fan 112 of the air conditioning system 100, a fault indication signal is sent to the remote indication device 170 of the air conditioning system 100 through the refrigerant leakage indication signal interface 212 of the air conditioning system 100, to control the remote indication device 170 to issue an alarm.

In the embodiment of the present disclosure, in a case that the refrigerant is leaked, the indoor fan 112 is started, to prevent the refrigerant from gathering, quickly diffuse the leaked refrigerant, thereby reducing the refrigerant concentration, thus preventing safety hazards. In addition, or alternatively, the remote indication device 170 is turned on in a case that the refrigerant is leaked, to remotely indicate the refrigerant leakage fault through a warning light or signal. The indoor fan 112 may be controlled to operate at maximum rotating speed, to quickly blow away the leaked refrigerant.

In step 305, a control signal for turning on the indoor ventilator controllable switch 209 of the air conditioning system 100 is generated, to start the indoor ventilator 180 of the air conditioning system 100.

In the embodiment of the present disclosure, in a case that the refrigerant is leaked, the processing unit 203 of the control device generates a control signal for turning on the indoor ventilator controllable switch 209 of the air conditioning system 100, to start the indoor ventilator 180 of the air conditioning system 100, to quickly diffuse the leaked refrigerant to the outside, thereby rapidly reducing the refrigerant concentration, thus preventing safety hazards.

In step 306, the outdoor controller power supply controllable switch 205 of the control device 200 is controlled to be turned on, to turn on the outdoor controller 124 of the air conditioning system 100, the liquid pipe solenoid valve controllable switch 20611 of the control device 200 is controlled to be turned off, to maintain the liquid pipe solenoid valve 115 of the air conditioning system 100 in a closed state, the gas pipe solenoid valve controllable switch 20612 of the control device 200 is controlled to be turned on, to open the gas pipe solenoid valve 116, and the compressor starting signal controllable switch 2071 of the control device 200 is controlled to be turned on, to start the compressor 121 of the air conditioning system 100.

In the embodiment of the present disclosure, the unit of the air conditioning system 100 is controlled in a refrigeration state, and the compressor 121 continuously draws out the refrigerant from the indoor unit 110. In this case, since the liquid pipe solenoid valve 115 is closed, the indoor refrigerant cannot be replenished, and the indoor refrigerant is recycled to the outdoor, the total amount of refrigerant released into the room is reduced, the refrigerant leakage rate is reduced, increasing safety. In order to improve the efficiency of discharging refrigerant, the compressor 121 may be controlled to operate at the maximum frequency under a full load.

It should be noted that steps 303 to 306 may be performed simultaneously.

In the embodiment of the present disclosure, in a case that the air conditioning system is in the heating mode, the method further includes: sending a directional valve switching signal to the directional valve 126 of the air conditioning system 100 through the directional valve switching signal interface 208 of the air conditioning system 100, to switch the directional valve 126 to a first state, where the first state is a state of the directional valve 126 when the air conditioning system 100 is in the refrigeration mode.

In step 307, it is determined whether a duration of the alarm is greater than a preset time threshold. If the duration of the alarm is greater than the preset time threshold, step 308 is performed; if the duration of the alarm is not greater than the preset time threshold, step 306 is performed continually.

In the embodiment of the present disclosure, it takes a period of time to recover the refrigerant in the room, so the preset time needs to be greater than or equal to the period of time for recovering the refrigerant in the room.

In step 308, a control signal for turning off the gas pipe solenoid valve controllable switch 20612 of the air conditioning system 100, turning off the compressor starting signal controllable switch 207 of the air conditioning system 100, and turning off the outdoor controller power supply controllable switch 205 of the air conditioning system 100 is generated, to turn off the outdoor controller 124 of the air conditioning system 100, maintain the gas pipe solenoid valve 116 of the air conditioning system 100 being closed, and stop the compressor 121 of the air conditioning system 100.

In the embodiment of the present disclosure, if the duration of the alarm is greater than the preset time threshold, the control signal for turning off the gas pipe solenoid valve controllable switch 20612 of the air conditioning system 100, turning off the compressor starting signal controllable switch 2071 of the air conditioning system 100, and turning off the outdoor controller power supply controllable switch 205 of the air conditioning system 100 is generated, to turn off the outdoor controller 124 of the air conditioning system 100, maintain the gas pipe solenoid valve 106 of the air conditioning system 100 being closed, and stop the compressor 121 of air conditioning system 100, to stop recovering refrigerant.

Figure 7:
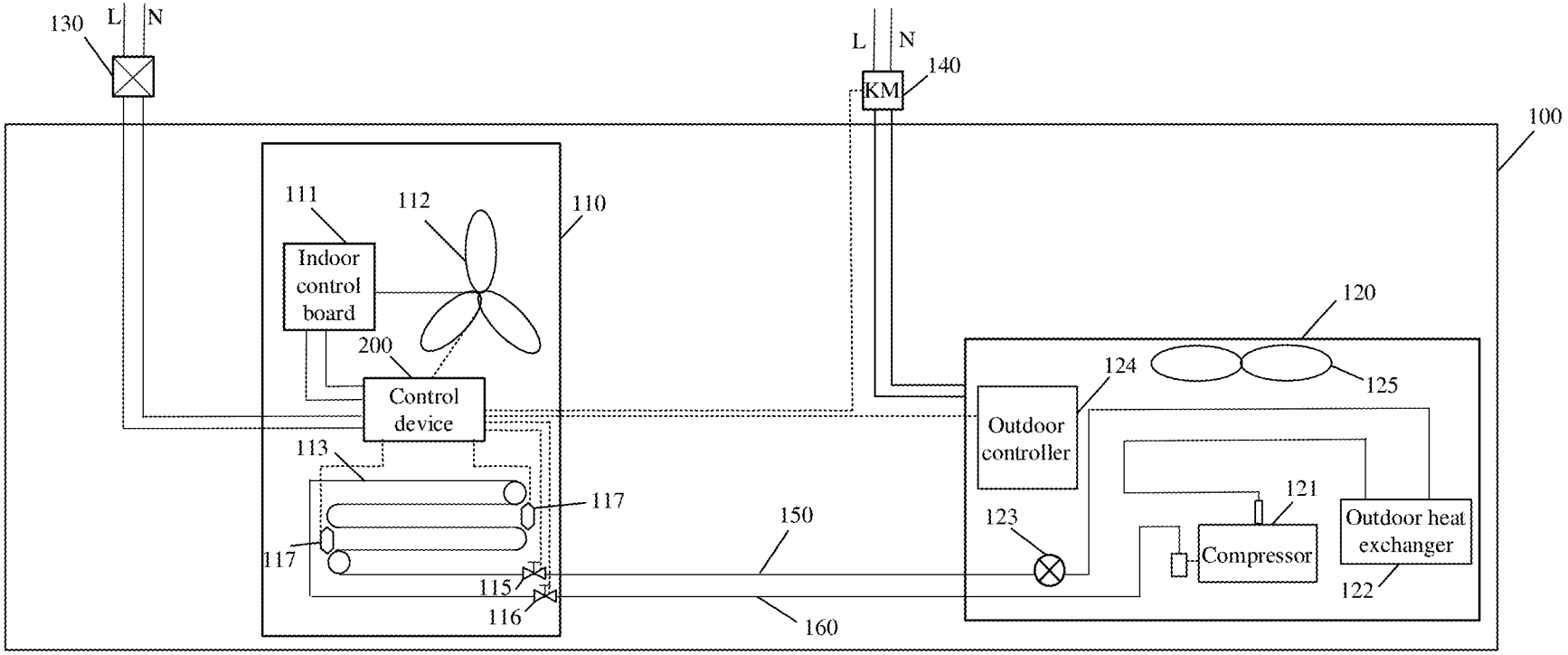
FIG. 7 is a schematic diagram of an air conditioning system according to an embodiment of the present disclosure.

FIG. 7 is a structural schematic diagram of an air conditioning system according to the embodiment of the present disclosure. As shown in FIG. 7, the air conditioning system 100 includes an indoor control board 111, an outdoor controller 124, a compressor 121, a throttle valve 123, an indoor fan 112, and the control device 200 as described in the above. As shown in FIG. 7, compared to the air conditioning system 100 shown in FIG. 1, refrigerant sensors 117 and the control device 200 are arranged in the air conditioning system 100 according to the embodiment of the present disclosure, and the information related to the refrigerant concentration may be detected. Thus, it can be determined whether the refrigerant is leaked based on the detected information related to the refrigerant concentration. Compared to determining whether the refrigerant is leaked by collecting some parameters during the running of the air conditioning system, the present disclosure has higher accuracy, and higher reliability and safety. The control device 100 may be the control device 200 shown in FIGS. 2 and 3, or the control device described in the above embodiments, which is not be repeated here.

Figure 8:
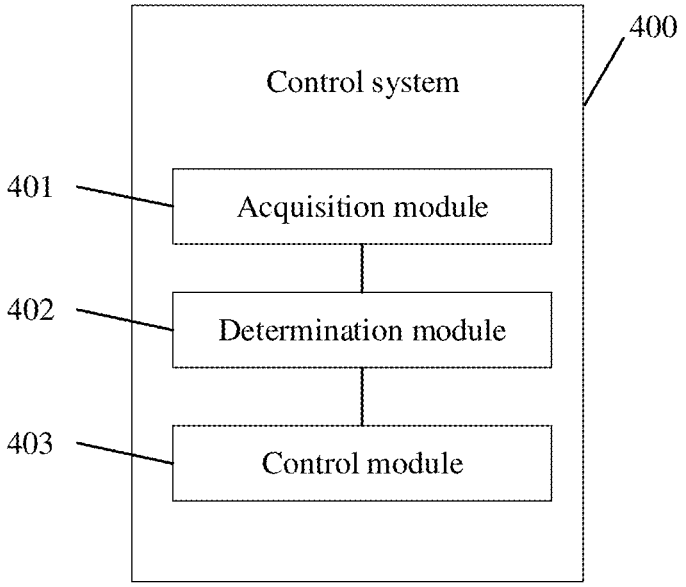
FIG. 8 is a schematic diagram of a control system of a control device according to an embodiment of the present disclosure.

In an embodiment, as shown in FIG. 4, the air conditioning system further includes a liquid pipe solenoid valve 115, a gas pipe solenoid valve 116, an indoor ventilator 180, and a remote indication device 170. FIG. 8 is a structural schematic diagram of a control system of a control device according to an embodiment of the present disclosure. As shown in FIG. 8, the control system 400 includes an acquisition module 401, a determination module 402, and a control module 403. The acquisition module 401 is configured to acquire refrigerant information from a refrigerant sensor. The determination module 402 is configured to determine whether the refrigerant is leaked based on the refrigerant information. The control module 403 is configured to generate a control signal for turning off the indoor control board power supply controllable switch of the air conditioning system in a case that the refrigerant is leaked, to turn off the indoor control board of the air conditioning system.

In the embodiment of the present disclosure, the refrigerant information includes refrigerant concentration and/or refrigerant concentration growth rate. The determination module 402 is specifically configured to determine whether the refrigerant concentration is greater than an alarm refrigerant concentration, and/or to determine whether the refrigerant concentration growth rate is greater than an alarm refrigerant growth rate.

The determination module 402 is further configured to trigger the acquisition module 401 to continually perform the operation of acquiring the refrigerant information from the refrigerant sensor, if the determination module 402 determines that the refrigerant is not leaked.

Figure 9:
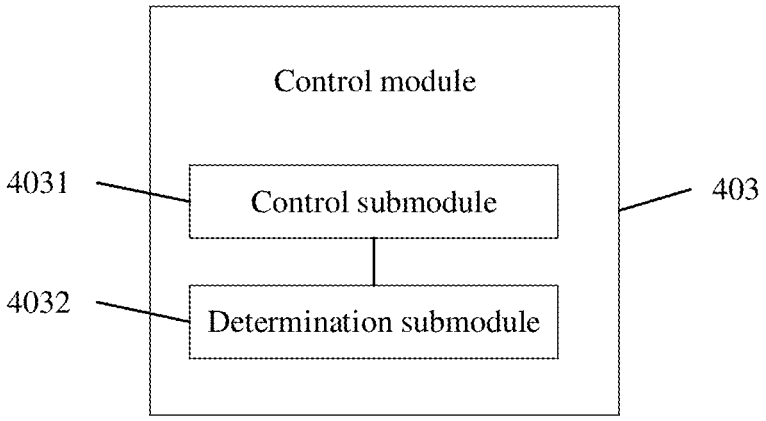
FIG. 9 is a function block diagram of a control module of a control system according to an embodiment of the present disclosure.

In the embodiment of the present disclosure, FIG. 9 is a structural schematic diagram of a control module of a control system according to an embodiment of the present disclosure. As shown in FIG. 9, the control module 403 specifically includes a control submodule 4031 and a determination submodule 4032.

The control submodule 4031 is configured to control, if the determination module 402 determines that the refrigerant is leaked, the outdoor controller power supply controllable switch 205 of the control device 200 to be turned on, to turn on the outdoor controller power supply 140 of the air conditioning system 100; control the liquid pipe solenoid valve controllable switch 2061 of the control device 200 to be turned off, to maintain the liquid pipe solenoid valve 115 of the air conditioning system 100 being closed; control the gas pipe solenoid valve controllable switch 2062 of the control device 200 to be turned on, to open the gas pipe solenoid valve 116; and control the compressor starting signal controllable switch 207 of the control device 200 to be turned on, to start the compressor 121 of the air conditioning system 100, to recovery the refrigerant.

The determination submodule 4032 is configured to determine whether the duration of the alarm is greater than the preset time threshold.

The determination submodule 4032 is further configured to trigger, if the determination submodule 4032 determines that the duration of the alarm is less than or equal to the preset time threshold, the control submodule 4031 to continually perform the operation of sending a liquid pipe solenoid valve control signal for closing the liquid pipe solenoid valve 115 to the liquid pipe solenoid valve controllable switch 2061, and sending a compressor starting signal control signal for starting the compressor 121 to the compressor starting signal controllable switch 207.

The control submodule 4031 is further configured to send, if the determination submodule 4032 determines that the duration of the alarm is greater than the preset time threshold, a gas pipe solenoid valve control signal for closing the gas pipe solenoid valve 116 to the gas pipe solenoid valve controllable switch 2062, send a compressor starting signal control signal for closing the compressor 121 to the compressor starting signal controllable switch 207, and send an outdoor power supply control signal for turning off the outdoor controller power supply 140 to the outdoor controller power supply controllable switch 205.

The control system according to the embodiment of the present disclosure may be used to implement the control method shown in FIGS. 5 and 6. The specific description may refer to the embodiment of the above control method, which is not repeated here.

Figure 10:
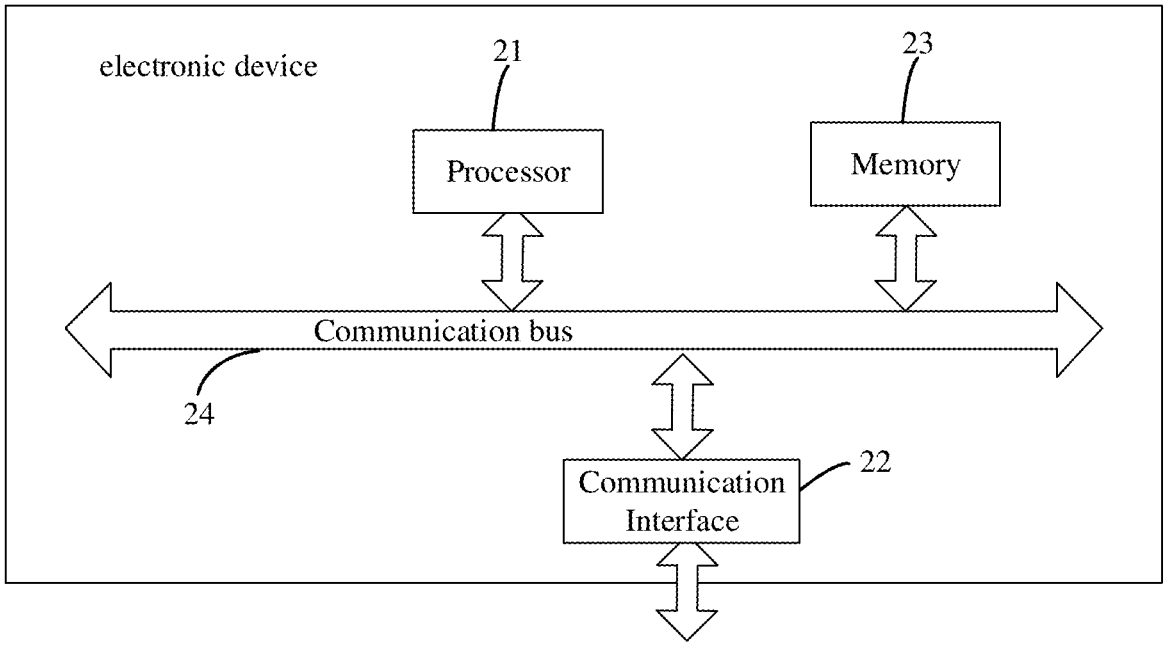
FIG. 10 is a function block diagram of an electronic device according to the description.

FIG. 10 is a structural schematic diagram of an electronic device according to an embodiment in the description. As shown in FIG. 10, the electronic device may include at least one processor 21, and at least one memory 23 in communication with the at least one processor 21. The at least one memory 23 stores program instructions executable by the at least one processor, and the at least one processor 21 calls the program instructions to execute the control method shown in FIGS. 5 and 6 according to the embodiment of the description.

In the several embodiments provided in the description, it should be understood that the disclosed systems, devices, and methods may be implemented in other ways. For example, the device embodiments described above are only schematic. For example, the division of the units is only a logical functional division, and there may be other division methods in actual implementation. For example, multiple units or components may be combined or integrated into another system, or some features may be ignored or not be executed. On the other hand, the coupling or direct coupling or communication connection between each other shown or discussed may be implemented by some interfaces, the indirect coupling or the communication connection of devices or units may be electrical, mechanical or other forms.

In addition, the functional units in the embodiments of the description may be integrated in one processing unit, or the units may physically exist separately, or two or more units may be integrated in one unit. The above-mentioned integrated units may be implemented in the form of hardware, or in the form of functional units combining hardware and software.

The above is only the preferred embodiments of the description, and is not used to limit the description. Any modification, equivalent replacement, improvement, etc., within the spirit and the principle of the description, should be included within the protection scope of the description.

The invention claimed is:

1. A control device, comprising a processor, an indoor control board power supply controllable switch, and a refrigerant sensor interface, wherein a terminal of the refrigerant sensor interface is electrically connected to the processor, and another terminal of the refrigerant sensor interface is electrically connected to a refrigerant sensor; or the refrigerant sensor interface communicates with the refrigerant sensor; and the processor is configured to acquire refrigerant information from the refrigerant sensor at least through the refrigerant sensor interface; and a control terminal of the indoor control board power supply controllable switch is electrically connected to the processor, a first terminal of the indoor control board power supply controllable switch is electrically connected to a power supply terminal of the indoor control board, and a second terminal of the indoor control board power supply controllable switch is electrically connected to a control device power supply output terminal; and the processor is configured to control the indoor control board power supply controllable switch to be turned on or turned off at least based on the refrigerant information, to turn on or turn off the indoor control board, wherein the control device further comprises an indoor fan controllable switch, wherein a control terminal of the indoor fan controllable switch is electrically connected to the processor, a first terminal of the indoor fan controllable switch is electrically connected to an indoor fan, and a second terminal of the indoor fan controllable switch is electrically connected to the control device power supply output terminal, wherein the processor is further configured to control the indoor fan controllable switch to be turned on or turned off at least based on the refrigerant information, to start or stop the indoor fan after controlling the indoor control board power supply controllable switch.

2. The control device according to claim 1, further comprising an outdoor controller power supply controllable switch, an indoor and outdoor connection valve controllable switch or an indoor and outdoor connection valve interface, a compressor starting signal controllable switch or a compressor starting signal interface; wherein a control terminal of the outdoor controller power supply controllable switch is electrically connected to the processor, a first terminal of the outdoor controller power supply controllable switch is electrically connected to a power supply terminal of an outdoor controller, and a second terminal of the outdoor controller power supply controllable switch is electrically connected to the control device power supply output terminal; and the processor is further configured to control the outdoor controller power supply controllable switch to be turned on or turned off at least based on the refrigerant information, to turn on or turn off the outdoor controller;

a control terminal of the indoor and outdoor connection valve controllable switch is electrically connected to the processor, a first terminal of the indoor and outdoor connection valve controllable switch is electrically connected to an indoor and outdoor connection valve, and a second terminal of the indoor and outdoor connection valve controllable switch is electrically connected to the control device power supply output terminal; and the processor is further configured to control the indoor and outdoor connection valve controllable switch to be turned on or turned off at least based on the refrigerant information, to open or close the indoor and outdoor connection valve;

a terminal of the indoor and outdoor connection valve interface is electrically connected to the processor, and another terminal is electrically connected to the indoor and outdoor connection valve; and the processor is further configured to send a connection valve on or off signal to the indoor and outdoor connection valve at least based on the refrigerant information, to open or close the indoor and outdoor connection valve;

a control terminal of the compressor starting signal controllable switch is electrically connected to the processor, a first terminal of the compressor starting signal controllable switch is electrically connected to a compressor, and a second terminal of the compressor starting signal controllable switch is electrically connected to the control device power supply output terminal; and the processor is further configured to control the compressor starting signal controllable switch to be turned on or turned off at least based on the refrigerant information, to start or stop the compressor; or a terminal of the compressor starting signal interface is electrically connected to the processor, and another terminal is electrically connected to an outdoor controller; and the processor is further configured to send a compressor on or off signal to the outdoor controller at least based on the refrigerant information, to start or stop the compressor.

3. The control device according to claim 2, further comprising a directional valve switching signal interface and/or an indoor ventilator controllable switch; wherein a terminal of the directional valve switching signal interface is electrically connected to the processor, and another terminal is electrically connected to a directional valve; and the processor is further configured to send a directional valve switching signal to the directional valve at least based on the refrigerant information, to control a state of the directional valve; and a control terminal of the ventilator controllable switch is electrically connected to the processor, a first terminal of the ventilator controllable switch is electrically connected to a ventilator, and a second terminal of the ventilator controllable switch is electrically connected to the control device power supply output terminal; and the processor is further configured to control the ventilator controllable switch to be turned on or turned off at least based on the refrigerant information, to start or stop the ventilator.

4. The control device according to claim 2, further comprising a refrigerant leakage indication signal interface, wherein a terminal of the refrigerant leakage indication signal interface is electrically connected to the processor, and another terminal is electrically connected to a remote indication device; and the processor is further configured to send a refrigerant leakage indication signal to the remote indication device at least based on the refrigerant information, to control the remote indication device to issue an alarm.

5. The control device according to claim 2, wherein the indoor and outdoor connection valve controllable switch comprises a liquid pipe solenoid valve controllable switch and a gas pipe solenoid valve controllable switch; or the indoor and outdoor connection valve interface comprises a liquid pipe solenoid valve interface and a gas pipe solenoid valve interface.

6. The control device according to claim 1, further comprising a 4-bit dial switch, wherein the processor is configured to set a number of the refrigerant sensor based on the function selection module 4-bit dial switch, and select the number of the refrigerant sensor interface corresponding to the number of the refrigerant sensor; or the processor is configured to select, based on a data input type set by the 4-bit dial switch, a data processing type corresponding to the data input type; or the processor is configured to select a function mode based on whether a refrigerant recovery function is set by the 4-bit dial switch.

7. The control device according to claim 1, wherein the refrigerant sensor is integrated into the control device.

8. A control method, applied to an air conditioning system comprising a control device according to claim 1, the control method comprising:

acquiring refrigerant information from a refrigerant sensor, and determining whether refrigerant is leaked based on the refrigerant information; and generating, in a case that the refrigerant is leaked, a control signal for turning off an indoor control board power supply controllable switch of the air conditioning system, to turn off an indoor control board of the air conditioning system.

9. The control method according to claim 8, wherein the refrigerant information comprises refrigerant concentration and/or refrigerant concentration growth rate; and wherein the determining whether refrigerant is leaked based on the refrigerant information comprises:

determining whether the refrigerant concentration is greater than a preset refrigerant concentration consecutively for one or more number of times, and/or determining whether the refrigerant concentration growth rate is greater than a preset refrigerant concentration growth rate.

10. The control method according to claim 8, wherein in a case that the refrigerant is leaked, the method further comprises:

controlling an outdoor controller power supply controllable switch of a control device to be turned on, to turn on an outdoor controller of the air conditioning system;

controlling a liquid pipe solenoid valve controllable switch of the control device to be turned off, to maintain a liquid pipe solenoid valve of the air conditioning system in a closed state;

controlling a gas pipe solenoid valve controllable switch of the control device to be turned on, to open a gas pipe solenoid valve; and controlling a compressor starting signal controllable switch of the control device to be turned on, to start a compressor of the air conditioning system.

11. The control method according to claim 10, wherein in a case that the air conditioning system is in a heating state, the method further comprises:

sending a directional valve switching signal to a directional valve through a directional valve switching signal interface of the control device, to switch the directional valve to a first state; wherein the first state is a state of the directional valve in a case that the air conditioning system is in a refrigeration mode.

12. The control method according to claim 8, wherein in a case that the refrigerant is leaked, the method further comprises:

generating a control signal for turning on an indoor fan controllable switch of a control device, to start an indoor fan of the air conditioning system;

sending a refrigerant leakage indication signal to a remote indication device through a refrigerant leakage indication signal interface of the control device, to control the remote indication device of the air conditioning system to issue an alarm; and generating, in a case that a duration of the alarm exceeds a preset time threshold, a control signal for turning off a gas pipe solenoid valve controllable switch, a compressor starting signal controllable switch and an outdoor power supply controllable switch, to close a gas pipe solenoid valve, stop a compressor and turn off an outdoor power supply.

13. The control method according to claim 8, wherein in a case that the refrigerant is leaked, the method further comprises:

generating a control signal for turning on an indoor ventilator controllable switch of a control device, to start an indoor ventilator of the air conditioning system.

14. The control method according to claim 8, wherein in a case that a control device of the air conditioning system is turned on, the method further comprises:

controlling the indoor control board power supply controllable switch of the control device to be turned on, to turn on the indoor control board of the air conditioning system;

controlling an outdoor controller power supply controllable switch of the control device to be turned on, to turn on an outdoor controller of the air conditioning system;

controlling an indoor and outdoor connection valve controllable switch of the control device to be turned on, to maintain an indoor and outdoor connection valve of the air conditioning system in an opened state; and controlling an indoor ventilator controllable switch to be turned off, to stop an indoor ventilator of the air conditioning system.

15. An air conditioning system, comprising an indoor control board and a control device according to claim 1; wherein a power supply input terminal of the control device is electrically connected to an input power supply; and the control device is electrically connected to the indoor control board at least through the indoor control board power supply controllable switch.

16. An air conditioning system, comprising an indoor control board and a control device according to claim 7; wherein a power supply input terminal of the control device is electrically connected to an input power supply; and the control device is electrically connected to the indoor control board at least through the indoor control board power supply controllable switch.

* * * * *